US006831413B2

(12) United States Patent
Kajiyama et al.

(10) Patent No.: US 6,831,413 B2
(45) Date of Patent: Dec. 14, 2004

(54) PLASMA DISPLAY PANEL

(75) Inventors: Hiroshi Kajiyama, Kodaira (JP); Akira Katou, Mito (JP); Kenichi Onisawa, Hitachinaka (JP); Tetsuro Minemura, Hitachiota (JP); Kazuo Uetani, Nishinomiya (JP); Yasushi Ihara, Takarazuka (JP); Shiro Takigawa, Kyoto (JP); Kouichi Nose, Osaka (JP); Isao Tokomoto, Ikeda (JP); Yasuhiro Koizumi, Nishinomiya (JP)

(73) Assignee: Hitachi, Ltd., Tokyo (JP)

( * ) Notice: Subject to any disclaimer, the term of this patent is extended or adjusted under 35 U.S.C. 154(b) by 322 days.

(21) Appl. No.: 10/196,267

(22) Filed: Jul. 17, 2002

(65) Prior Publication Data

US 2002/0190929 A1 Dec. 19, 2002

Related U.S. Application Data

(63) Continuation of application No. 10/073,099, filed on Feb. 12, 2002.

(30) Foreign Application Priority Data

Jun. 19, 2001 (JP) ..... 2001-185297

(51) Int. Cl.[7] ..... H01J 17/49; H01J 11/02
(52) U.S. Cl. ..... 313/587; 313/586; 313/582
(58) Field of Search ..... 313/582, 586, 313/587

(56) References Cited

U.S. PATENT DOCUMENTS 5,703,437 A * 12/1997 Komaki ..... 313/587
5,938,494 A 8/1999 Betsui et al.
6,149,967 A 11/2000 Mitamura et al.
6,245,394 B1 6/2001 Sakemi et al.
6,329,751 B2 * 12/2001 Yoo ..... 313/582
6,650,063 B2 * 11/2003 Uemura et al. ..... 315/169.4

FOREIGN PATENT DOCUMENTS

JP 08077931 A * 3/1996 ..... H01J/11/02
JP 10-162743 6/1998
JP 2000164136 A * 6/2000 ..... H01J/11/02

OTHER PUBLICATIONS

Plasma Display, The Journal of The Institute of Electrical Engineers of Japan.

* cited by examiner

*Primary Examiner*—Nimeshkumar D. Patel
*Assistant Examiner*—Mariceli Santiago
(74) *Attorney, Agent, or Firm*—Dickstein Shapiro Morin & Oshinsky LLP

(57) ABSTRACT

A plasma display panel (PDP), consisting of a front panel (10) equipped with display electrodes (8) and a rear panel (4) equipped with address electrodes (3), that displays an image by causing discharge in a small discharge space formed between the two panels; wherein there are provided two layers of protective films (5, 6), made of metallic oxide, covering the dielectric layer (7) installed on the front panel (10); the outer, upper layer (6) being formed into a layer of material with a specific surface area of 20 $m^2/g$ or more and a film thickness of 1 $\mu m$ or less, exhibiting a high discharge characteristic; and the inner, lower layer (5) being formed into a layer of material with a specific surface area of 10 $m^2/g$ or less and a film thickness of 1 $\mu m$ or more, exhibiting a low water-adsorption characteristic.

3 Claims, 2 Drawing Sheets

FIG. 2
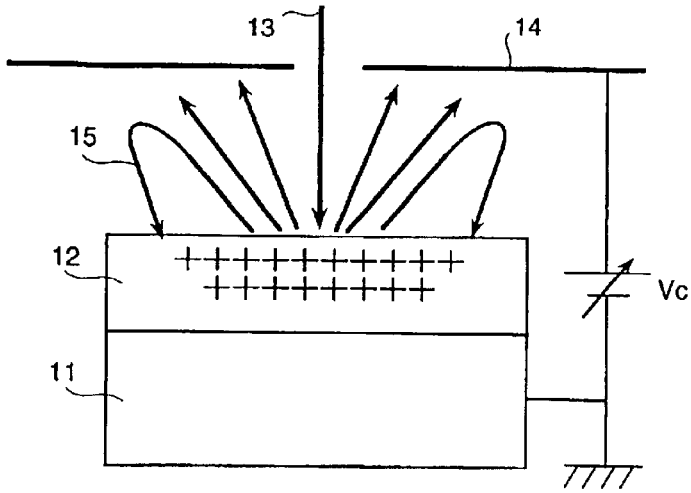
FIG. 3
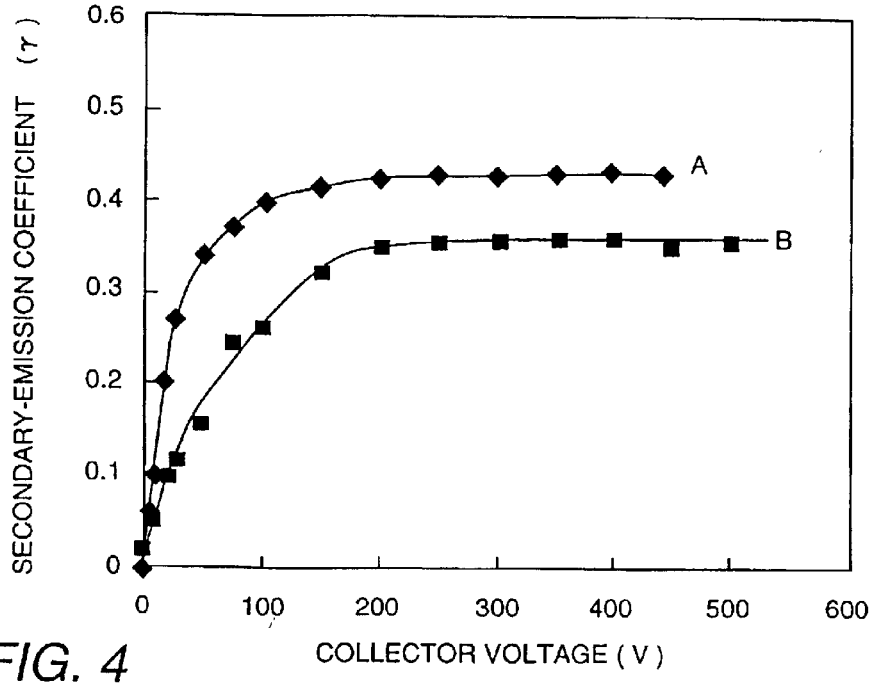
FIG. 4
| | CRYSTALLI-NITY | SPECIFIC SURFACE AREA | SECONDARY-EMISSION COEFFICIENT | FILM THICKNESS |
|---|---|---|---|---|
| LOWER PROTECTIVE FILM 5 | LOW | SMALL ○ | LOW | LARGE ○ |
| UPPER PROTECTIVE FILM 6 | HIGH ○ | LARGE | HIGH ○ | SMALL |

PLASMA DISPLAY PANEL

CROSS REFERENCE TO RELATED APPLICATIONS

The present application is a continuation application of U.S. patent application Ser. No. 10/073,099 filed on Feb. 12, 2002, the disclosure of which is herewith incorporated by reference in its entirety.

BACKGROUND OF THE INVENTION

1. Field of the Invention

The present invention relates to a plasma display panel (hereinafter, referred to as PDP) used as a display device, and more particularly to a protective film for electrodes.

2. Description of Prior Art

PDP is a display device provided with a number of small discharge spaces enclosed between two glass substrates. On a matrix display type PDP, there are provided a number of electrodes in the form of a lattice, and an image is displayed by selectively causing discharge cells on the intersection of each electrode to emit light. On a typical AC-type PDP of a surface discharge type, the display electrodes on the front panel are covered with a dielectric layer and a protective film is formed over the dielectric layer. The dielectric layer is provided so as to store the electric charge resulting from applying voltage to the electrodes, and the protective film is provided so as to protect the dielectric layer from damage by collision of ions in the discharge gas and also to emit secondary electron to decrease the discharge starting voltage. PDPs like the above are described in, for example, "Plasma Display" (The Journal of the Institute of Electrical Engineers of Japan, Vol. 119, No. 6, pp346–349, 1999).

Conventionally, a magnesium oxide film of some several hundred nm thick, formed by a film forming method such as vapor deposition, has been mostly used as the protective film. This magnesium oxide film normally has adsorbed moisture, carbon dioxide, oxygen, hydrogen, and some others. It is of a concern that these materials affect the discharge characteristic in the beginning and also have an adverse effect on the operating condition of a PDP as they are discharged as impurity gas into the charged gas during the operation of the PDP. In particular, they have an adverse effect on the secondary electron emission characteristic that significantly affects the discharge voltage.

In the production process of present PDP, panels are subjected to degassing before charging with discharge gas. Any gas that has not been removed through this degassing process remains as impurity gas in the finished product. Moisture and carbon dioxide adsorbed in the protective film are particularly hard to be eliminated, hence requiring the degassing process at a higher temperature for a longer time. In many cases, this long-time degassing process can be a decisive factor of the speed of a whole production line. Since degassing at a high temperature affects other components, there is a certain limitation.

SUMMARY OF THE INVENTION

The protective film of an AC-type PDP is required to have higher secondary electron emission characteristic and, at the same time, is stable during the operation. While, in the production process of PDP, gas components, particularly moisture and carbon dioxide, adsorbed in the protective film are eliminated so as to activate the protective film, this elimination must be accomplished easily. There has been a problem with a conventional protective film that, because the film adsorbs a great amount of moisture and carbon dioxide, much of them remains even after vacuum heating at 350° C. As a result, they have an adverse effect on the effective secondary electron emission characteristic of the finished panels and degrade the discharge characteristic. In addition, because impurity gas is emitted from the protective film during the operation, there arises a defect that the discharge characteristic is not stable. For this reason, special measures such as increasing the heating temperature and extending the degassing time are required, resulting in an increase of the production cost.

The present invention is proposed for solving the aforementioned problems associated with the prior art, and an object of the present invention is to provide a PDP equipped with a PDP-electrode protective film that has less moisture and carbon dioxide adsorption, high secondary electron emission characteristic and superior stability.

According to the present invention that solves the aforementioned problems, there is provided a plasma display panel, having a front panel equipped with display electrodes and a rear panel equipped with address electrodes, and displaying an image by causing discharge in a discharge space formed between the front and rear panels, wherein a protective film installed on the discharge side of the front panel comprises two layers, one of which is an upper (outer) layer being made of material with high discharge characteristic and the other is a lower (inner) layer being made of material with low water-adsorption characteristic.

Otherwise, the front panel is equipped with a protective film comprising two layers, upper layer and lower layer, of different specific surface area per unit weight, which upper layer is so formed as to have a large specific surface area and a thin film thickness and which lower layer is so formed as to have a smaller specific surface area and a thicker film thickness than that of the upper layer. The upper layer is formed into a layer of material with a specific surface area of 20 $m^2/g$ or more, as converted per 1 g of the protective film, and a film thickness of 1 $\mu$m or less, and the lower layer is formed into a layer of material with a specific surface area of 10 $m^2/g$ or less, as converted per 1 g of the protective film, and a film thickness of 1 $\mu$m or more.

Use of a material with greater specific surface area as the protective film of PDP increases the discharge characteristic. For this reason, an oxide film with the specific surface area of 20 $m^2/g$ or more is used as the upper film. With this, the coefficient of secondary electron emission from the protective film improves, resulting in a decrease of the charge starting voltage of the PDP. When the specific surface area is smaller, on the other hand, even if adsorption of moisture and carbon dioxide is caused in the course of the film forming process or in any PDP production process after that, the absolute amount of adsorption is small and they can be eliminated easily in the heat degassing process. For this reason, a material with the specific surface area of 10 $m^2/g$ or less is used as the lower film. With this, adsorbed moisture and carbon dioxide can be easily eliminated through the heat degassing process at 350° C. or less. Even if the heat degassing process is insufficient, the residual amount adsorbed in the protective film is less. The time required for the heat degassing process depends upon the panel size and cell structure and also on the capacity and method of the degassing system. Thus, the time cannot always be determined in a simple manner but is two hours or so approximately for normal panels.

An oxide is used as the protective film for the PDP according to the present invention, and an oxide film mainly made from magnesium oxide is particularly preferred. Naturally, any other components may be contained so as to change the characteristic of the magnesium oxide.

BRIEF DESCRIPTION OF THE DRAWINGS

FIG. 2 is a schematic diagram showing a measuring apparatus used to measure the coefficient of secondary electron emission.

FIG. 3 is a diagram showing the measurement result of the characteristic of the secondary electron emission coefficient.

FIG. 4 is an explanatory diagram showing the characteristic comparison between the lower protective film 5 and the upper protective film 6.

DESCRIPTION OF EMBODIMENTS OF THE INVENTION

Figure 1A:
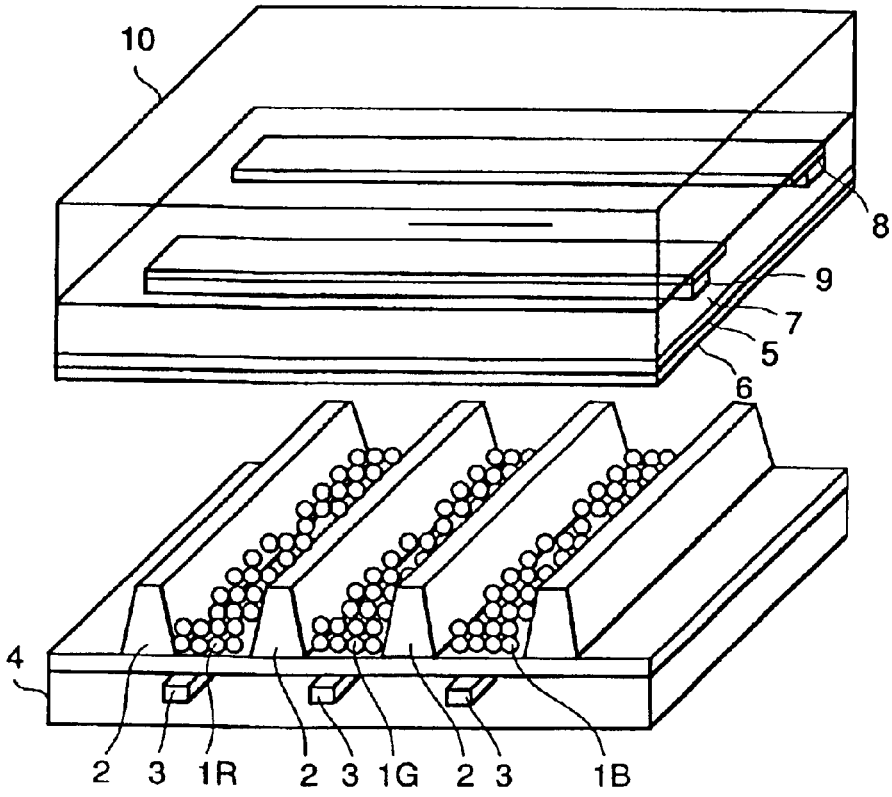
FIG. 1*a* is a schematic diagram showing the construction of a picture element of the AC-type PDP according to an embodiment of the present invention.
Figure 1B:
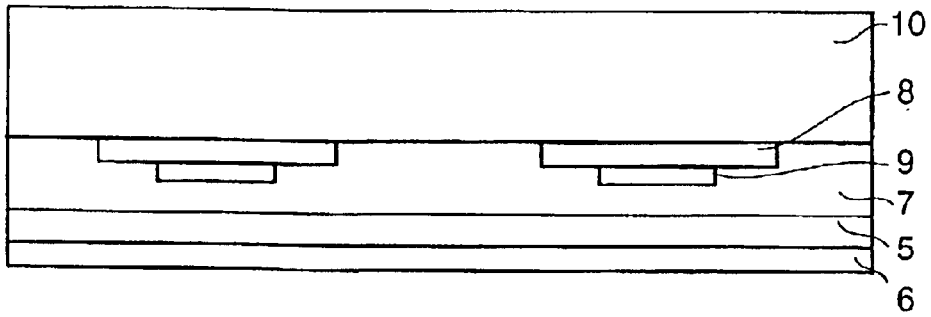
FIG. 1*b* is a sectional view of a part of FIG. 1*a*.

FIGS. 1*a* and 1*b* show the construction of a picture element in a preferred mode of embodiment of the PDP to which the protective film according to the present invention is applied. FIG. 1*a* is an enlarged perspective view and FIG. 1*b* is a sectional view of a part of FIG. 1*a*.

As shown in FIG. 1*a*, a front panel 10 and a rear panel 4 are installed, facing each other, on a PDP. The rear panel 4 is provided with three different luminescent materials 1R, 1G and 1B, separated from each other by partitions 2, for displaying a picture element. It is so designed that the picture element is displayed in any color by means of the three luminescent materials 1R, 1G and 1B.

The rear panel 4 is equipped with address electrodes 3 arranged along the Y-axis. Besides, the front panel 9 is equipped with display electrodes 8 along the X-axis perpendicularly to the address electrodes. The display electrodes 8 are equipped with bus electrodes 9 along the same direction. The display electrodes 8 and bus electrodes 9 are coated with a dielectric layer 7. In addition, there are provided protection films 5 and 6 on the surface of the dielectric layer 6.

The space between the front panel 10 and the rear panel 4 is filled with a rare gas at a specified pressure as the discharge gas. Normally, a mixture of rare gas elements is used as the gas medium. To be concrete, one or more gas elements selected out of helium, neon, xenon and krypton are used. Particular charging pressure of the gas is not specified but 400 to 760 Torr is desirous.

When a specified voltage is applied to the address electrodes 3, display electrodes 8 and bus electrodes 9, the luminescent material 1 emits light resulting from the ultraviolet rays accompanied by the plasma discharge of the rare gas, and then a visible light is emitted outside from the front panel 10 and the corresponding picture element is displayed accordingly.

With the PDP protective film from which adsorbed moisture and carbon dioxide can be easily eliminated according to the present invention, the coefficient of secondary electron emission from the protective film improves, resulting in a decrease of the charge starting voltage of the PDP. Besides, impurity gas emitted from the protective film during the operation is less and the discharge characteristic is stable.

Any method of film forming is permissible for the PDP protective film according to the present invention provided that the physical characteristic defined as an object of the invention, i.e. the moisture-eliminating characteristic is achieved. Any method such as electron-beam vapor deposition, spattering, or ion plating is permissible. In order to materialize a film having the specific surface area required by the present invention, however, each method needs a special measure, for example, for optimizing the film forming condition. Several embodiments of the PDP-electrode protective films according to the present invention are explained hereunder.

In the embodiments of the present invention, films are formed either by ion plating or by electron-beam vapor deposition. Magnesium oxide granules are used as the material of the film and, by supplying oxygen gas into a vacuum system, the protective films 5 and 6 made of magnesium oxide are formed. The substrate heating temperature and oxygen gas supply are varied in forming a film so as to form various films of different physical characteristics.

Embodiment 1 (Protective films M1 & M2)

Protective films M1 and M2 of the embodiment 1 are formed through ion plating. Oxygen gas at a pressure of $3\times10^{-2}$ Pa is introduced into a vacuum film forming system, and a glass substrate is heated to each 350° C. and 400° C. by a substrate heater to form each protective film M1 and M2. The film forming speed is 1 nm per second. High frequency of 1.5 kW is applied to the high-frequency coil. A negative DC bias voltage of 100 to 400 kV is applied to the substrate.

The specific surface area of the protective films is measured by the B.E.T. method based on Kr gas adsorption, and that of the protective film M1 is 9.5 $m^2/g$ and M2 is 7.5 $m^2/g$. Both protective films M1 and M2 maintain desirous specific surface area to serve as the lower protective film 5 in FIGS. 1*a* and 1*b*.

Embodiment 2 (Protective films M3 & M4)

Protective films M3 and M4 of the embodiment 2 are formed through electron-beam vapor deposition. Oxygen gas at a pressure of $1\times10^{-2}$ Pa is introduced, and a glass substrate is heated to each 350° C. and 400° C. to form each protective film M3 and M4 The film forming speed is 1 nm per second.

The specific surface area of the protective films is measured by the B.E.T. method based on Kr gas adsorption, and that of the protective film M3 is 6.5 $m^2/g$ and M4 is 4.5 $m^2/g$. Both protective films M3 and M4 maintain desirous specific surface area to serve as the lower protective film 5.

Embodiment 3 (Protective films M5 & M6)

Protective films M5 and M6 of the embodiment 3 are formed through ion plating. Oxygen gas at a pressure of $2\times10^{-2}$ Pa is introduced into a vacuum film forming system, and a glass substrate is heated to 200° C. by a substrate heater or by irradiation of light including infrared rays to form the protective film M5 of 0.5 $\mu$m thick. And then, the glass substrate is further heated to 250° C. to form the protective film 6 of 0.1 $\mu$m thick. The film forming speed is 1 nm per second in each process. High frequency of 0.5 to 1.5 kW is applied to the high-frequency coil. A negative DC bias voltage of 100 to 800 kV is applied to the substrate.

The specific surface area of the protective films is measured by the B.E.T. method based on Kr gas adsorption, and that of the protective film M5 is 105.3 $m^2/g$ and M6 is 95.3 $m^2/g$. Both protective films M5 and M6 maintain desirous specific surface area to serve as the upper protective film 6.

On a protective film with the specific surface area exceeding 100 $m^2/g$, columnar structures grow favorably, extending from the interface of the substrate toward the film surface. In case of a film like this, moisture in the film can be eliminated easily by vacuum heating. For example, since 80 to 90% of the moisture in the film is eliminated through vacuum heating at 350° C. for 3 hours, residual moisture does not cause a difficulty in using the film as the PDP protective film.

Embodiment 4 (Protective films M7, M8 & M9)

Protective films M7, M8 and M9 of the embodiment 4 are formed through electron-beam vapor deposition. Oxygen gas at a pressure of $3\times10^{-2}$ Pa is introduced, and a glass substrate is heated to each 150° C., 200° C. and 250° C. to form each protective film M7, M8 and M9. The film forming speed is 1 to 3 nm per second. The film thickness obtained is 0.8 um.

The specific surface area of the protective films is measured by the B.E.T. method based on Kr gas adsorption, and that of each protective film M7, M8 and M9 is 55.7, 36.8 and 25.5 $m^2/g$, respectively. All protective films M7, M8 and M9 maintain desirous specific surface area to serve as the upper protective film 6.

Embodiment 5 (Protective film M10)

Protective film M10 of the embodiment 5 is formed through ion plating. For the protective film M10, the upper protective film 5 and lower protective film 6 are formed in sequence. The upper film 5 and lower film 6 are formed directly, without forming a dielectric layer 7, on the front panel that are provided with the display electrodes 8 and bus electrodes 9 as shown in FIGS. 1*a* and 1*b*.

The lower protective film 5 is formed as follows. Oxygen gas at a pressure of $3\times10^{-2}$ Pa is introduced into a vacuum film forming system, and a glass substrate is heated to 330° C. by a substrate heater or by irradiation of light including infrared rays to form a film at the forming speed of 1 um per second. The film thickness is 3 um. During the film forming, high frequency of 0.5 to 1.5 kW power is applied to the high-frequency coil. A negative DC bias voltage of 100 to 800 kV is applied to the substrate.

Then, the upper protective film 6 is formed as follows. Oxygen gas at a pressure of $5\times10^{-2}$ Pa is introduced into the vacuum film forming system, and the glass substrate is heated to 210° C. by a substrate heater or by irradiation of light including infrared rays to form a film at the forming speed of 1 to 3 $\mu$m per second. The film thickness is 0.5 $\mu$m. During the film forming, high frequency of 0.5 to 1.5 kW power is applied to the high-frequency coil. A negative DC bias voltage of 100 to 800 kV is applied to the substrate.

The specific surface area of the protective films is measured by the B.E.T. method based on Kr gas adsorption, and that of the protective film M10 is 18.5 $m^2/g$. The protective films M10 maintains desirous specific surface area to serve as the lower protective films 5 and upper protective film 6 in FIGS. 1*a* and 1*b*.

Next, the discharge characteristic of the PDP protective film is explained hereunder. FIG. 2 is a schematic diagram showing the construction of a measuring apparatus used to measure the coefficient of secondary electron emission. The coefficient of secondary electron emission is a parameter closely related to the discharge characteristic of the PDP.

A Ne ion beam 13 is irradiated onto the surface of a protective film 12, made of MgO and formed on a stainless steel substrate 11, so as to cause the secondary electrons 15 to be emitted, and the secondary electrons 15 are collected by the collector electrode 14 installed in front of the protective film 11. From the current generated in the collector electrode 14, the secondary electron emission ratio is obtained.

On the other hand, a bias voltage Vc is applied between the collector electrode 14 and stainless steel substrate 11 so that the collector electrode becomes positive, and therefore the secondary electrons 15 emitted from the protective MgO film 12 are all collected. When the voltage Vc applied to the electrode 14 is increased, adjusting a variable resistor 16, the voltage at the time when the secondary electron emission has saturated is regarded as the coefficient of secondary electron emission. To measure the secondary electron emission characteristic, a Ne ion beam is irradiated at acceleration energy of 500 eV.

FIG. 3 is an example of the measurement result, showing the change in the secondary electron emission characteristic by time. The specimen measured is so made as to have the protective film M2 of the embodiment 1 and protective film M6 of the embodiment 3 on a stainless steel substrate 11. In the diagram, curve "A" represents the result of the protective film M6 and curve "B" represents the result of the protective film M2.

It is understood that the secondary electron emission characteristic of the protective film M6 is superior to that of the protective film M2. The crystallinity of the two films are examined by X-ray diffraction measurement, and it is found that the crystal grains have grown more on the protective film M6 than on the protective film M2. Since a PDP protective film is required to have a greater secondary electron emission characteristic, it is understood that the protective film M6 exhibits superior crystallinity as a protective film material.

FIG. 4 summarizes the characteristics of the lower protective film 5 and upper protective film 6. Protective film is required to have higher crystallinity, smaller specific surface area, greater secondary electron emission coefficient, and thicker film thickness. A conventional protective film consisted of a single layer cannot satisfy all the requirements in the table. According to the present invention, a protective film consisting of two layers, the lower protective film 5 and upper protective film 2, can meet every item as given a circle in the table.

As explained above, using the protective film according to the present invention as the protective film of an AC-type PDP produces an effect that a stable secondary electron emission coefficient can be achieved. In addition, degassing condition in assembling the panels can be made simpler.

What is claimed is:

1. A plasma display panel having a front panel equipped with display electrodes and a rear panel equipped with address electrodes, and displaying an image by causing discharge in a discharge space formed between the front and rear panels, wherein said front panel is equipped with a protective film comprising two layers, upper layer and lower layer, of different specific surface area per unit weight, said upper layer being so formed as to have a specific surface area and a thin film thickness and said lower layer being so formed as to have a smaller specific surface area and a thicker film thickness than that of the upper layer.

2. A plasma display panel according to claim 1, wherein said upper layer is formed into a layer of material with a specific surface area of 20 $m^2/g$ or more, as converted per 1 g of the protective film, and a film thickness of 1 $\mu$m or less, and said lower layer is formed into a layer of material with a specific surface area of 10 $m^2/g$ or less, as converted per 1 g of the protective film, and a film thickness of 1 $\mu$m or more.

3. A plasma display panel according to claim 1, wherein at least, said upper layer of the protective film is made of a film containing magnesium oxide as main component.

* * * * *